US007188560B2

(12) United States Patent
Gabriel-Regis

(10) Patent No.: US 7,188,560 B2
(45) Date of Patent: Mar. 13, 2007

(54) FASTENING DEVICE FOR A GUN BARREL

(75) Inventor: Thierry Gabriel-Regis, Marmagne (FR)

(73) Assignee: GIAT Industries, Versailles (FR)

( * ) Notice: Subject to any disclaimer, the term of this patent is extended or adjusted under 35 U.S.C. 154(b) by 219 days.

(21) Appl. No.: 10/929,526

(22) Filed: Aug. 31, 2004

(65) Prior Publication Data

US 2007/0034075 A1 Feb. 15, 2007

(30) Foreign Application Priority Data

Sep. 3, 2003 (FR) ..... 03 10427

(51) Int. Cl.
*F41A 25/18* (2006.01)

(52) U.S. Cl. ..... 89/37.07; 89/37.11

(58) Field of Classification Search ..... 89/37.07, 89/37.11, 37.13, 37.14
See application file for complete search history.

(56) References Cited

U.S. PATENT DOCUMENTS

| | | | | |
|---|---|---|---|---|
| 1,196,197 | A * | 8/1916 | Witherow | 89/40.06 |
| 1,481,644 | A * | 1/1924 | Joyce | 89/37.11 |
| 3,169,607 | A | 2/1965 | Romney | |
| 3,837,260 | A * | 9/1974 | Agren et al. | 89/37.11 |
| 4,336,744 | A | 6/1982 | Kaustrater | |

FOREIGN PATENT DOCUMENTS

| | | |
|---|---|---|
| DE | 728 687 C | 12/1942 |
| RU | 2 086 878 C | 8/1997 |

* cited by examiner

*Primary Examiner*—Stephen M. Johnson
(74) *Attorney, Agent, or Firm*—Oliff & Berridge, PLC

(57) ABSTRACT

A fastening device for a gun barrel with respect to the turret of a carrier vehicle of the type incorporating a cheek integral with an oscillating mass carrying the gun barrel and an articulated part fastened to said turret, wherein said articulated part is fastened to said turret by a pivoting link and in that said part incorporates means to join it to said cheek.

7 Claims, 4 Drawing Sheets

FASTENING DEVICE FOR A GUN BARREL

BACKGROUND OF THE INVENTION

1. Field of Invention

The technical scope of the present invention is that of lashing devices for a gun barrel, that is to say devices to hold this barrel with respect to the chassis of a carrier vehicle.

2. Description of the Related Art

It is known for a gun carried by a tracked or wheeled vehicle to be subjected to loads during travelling and to eliminate these it is known to rigidly fasten this barrel on the carrier chassis by a so-called lashing system which avoids bending or deviation of the barrel.

Different fastening devices are known that use double-acting cylinders, articulated half-shells provided with screws and nuts, or jaws.

One major drawback to the devices using double-acting cylinders lies in the fact that such a device does not incorporate a locking system, and thus leaves a risk of opening, namely in the event of a drop in hydraulic pressure.

Fastening systems using articulated half-shells require human intervention for locking and unlocking operations.

The use of a jaw fastener system advantageously overcomes these drawbacks. Thus, patent FR-2757620 describes a fastening system for a gun barrel using two jaws that simply lock the gun barrel in a given position when it is lowered, unlocking being activated by the raising of the barrel.

A drawback to this system lies, however, in the fact that there is a certain give in the locking and additionally, the gun barrel can only be locked in one position, whereas it is sometimes necessary to have different locking positions. This is notably the case when the vehicle carrying the gun is transported by rail-road where it must meet certain dimensional conditions. The gun must in this case be in a substantially horizontal position. Moreover, during manoeuvres in the field, the gun risks touching the ground if it remains in a horizontal position. It is thus necessary for it to be locked in a raised position.

SUMMARY OF THE INVENTION

The aim of the present invention is to supply a holding and/or locking/unlocking device in different positions for a gun barrel. This device incorporates simple and robust parts and may be activated from inside the vehicle; it is able to ensure the retention of the gun, even when the hydraulic pressure drops.

The invention thus relates to a fastening device for a gun barrel with respect to the turret of a carrier vehicle of the type incorporating a cheek integral with an oscillating mass carrying the gun barrel and an articulated part fastened to the turret, wherein the articulated part is fastened to the turret by a pivoting link and in that it incorporates means to join it to the cheek.

According to one characteristic of the invention, the pivoting link is positioned such that the resultant of the loads exerted by the oscillating mass on the joining means generates a torque making the articulated part pivot towards the cheek.

According to another characteristic of the invention, the means joining the articulated part with the cheek is an elastic wedge that integrates into an indentation made in the cheek.

According to another characteristic, the cheek incorporates several indentations allowing the gun barrel to be immobilised in several different angular positions.

According to yet another characteristic, the articulated part is activated by means of a cylinder to engage or disengage the wedge in an indentation.

According to another characteristic, the device incorporates elastic means acting so as to hold the wedge in the indentation.

According to another characteristic, the elastic wedge is substantially trapezoidal in shape.

According to another characteristic, the wedge is carried by a cylindrical ball joint integral with the articulated part.

A first advantage of the device according to the invention lies in the possibility of locking the gun barrel in different positions.

Another advantage lies in its simplicity of manufacture.

Another advantage lies in the fact that, even if there is a problem with the cylinder (hydraulic leak, pressure failure), the system still ensures the retention of the barrel and remains able to be activated.

BRIEF DESCRIPTION OF THE DRAWINGS

Other characteristics, particulars and advantages of the invention will become apparent from the description given hereafter by way of illustration and in reference to the appended drawings, in which.

DETAILED DESCRIPTION OF PREFERRED EMBODIMENTS

Figure 1:
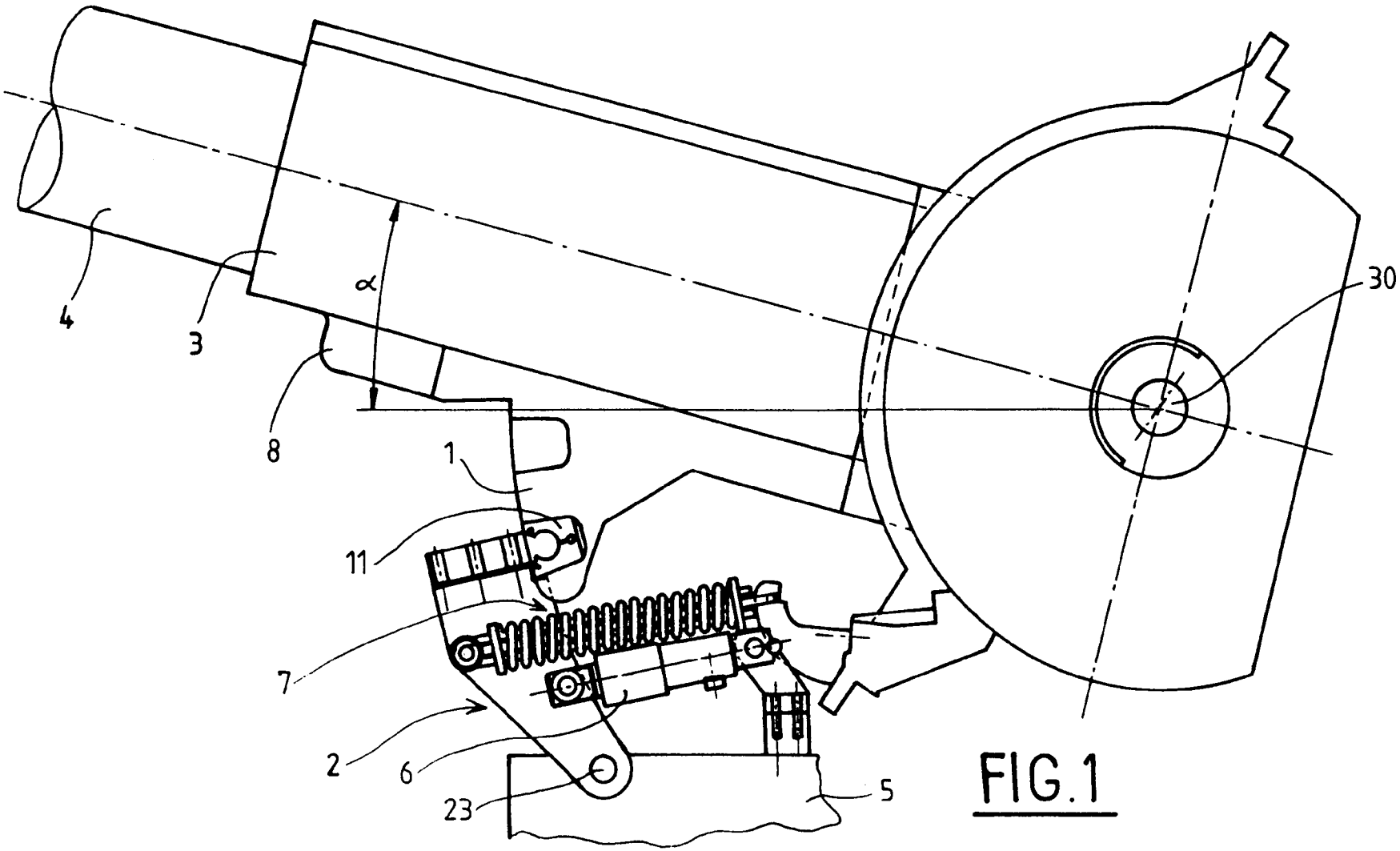
FIG. 1 is a general view of a gun barrel held by a lashing device according to the invention.

FIG. 1 shows a profile view of a gun barrel 4 of a military vehicle, for example, a tank, held by a lashing device according to the invention. The lashing device is composed of a cheek 1 and an articulated part 2. The cheek 1 is integral with the oscillating mass 3 of the cannon and the articulated part 2 is connected to the vehicle's turret 5 by a pivoting link 23 and is activated by a cylinder 6 and elastic means 7 comprising a spring. The gun barrel 4 is carried by the oscillating mass 3 in a known manner and the oscillating mass is fastened to the vehicle's turret 5 by a pivot 30.

Classically, the barrel 4 can slide with respect to the oscillating mass 3 during firing.

The oscillating mass 3 enabling the weapon to be laid thanks to the pivot 30 which allows both the oscillating mass 3 and the barrel 4 to be oriented with respect to the turret 5. The cheek 1, substantially plane in shape, will, for example, be fastened to one of several panels 8 of the oscillating mass 3.

In the position shown in this Figure, the lashing device allows the gun barrel to be held at an angle $\alpha$ of 15° with respect to the horizontal.

Figure 2:
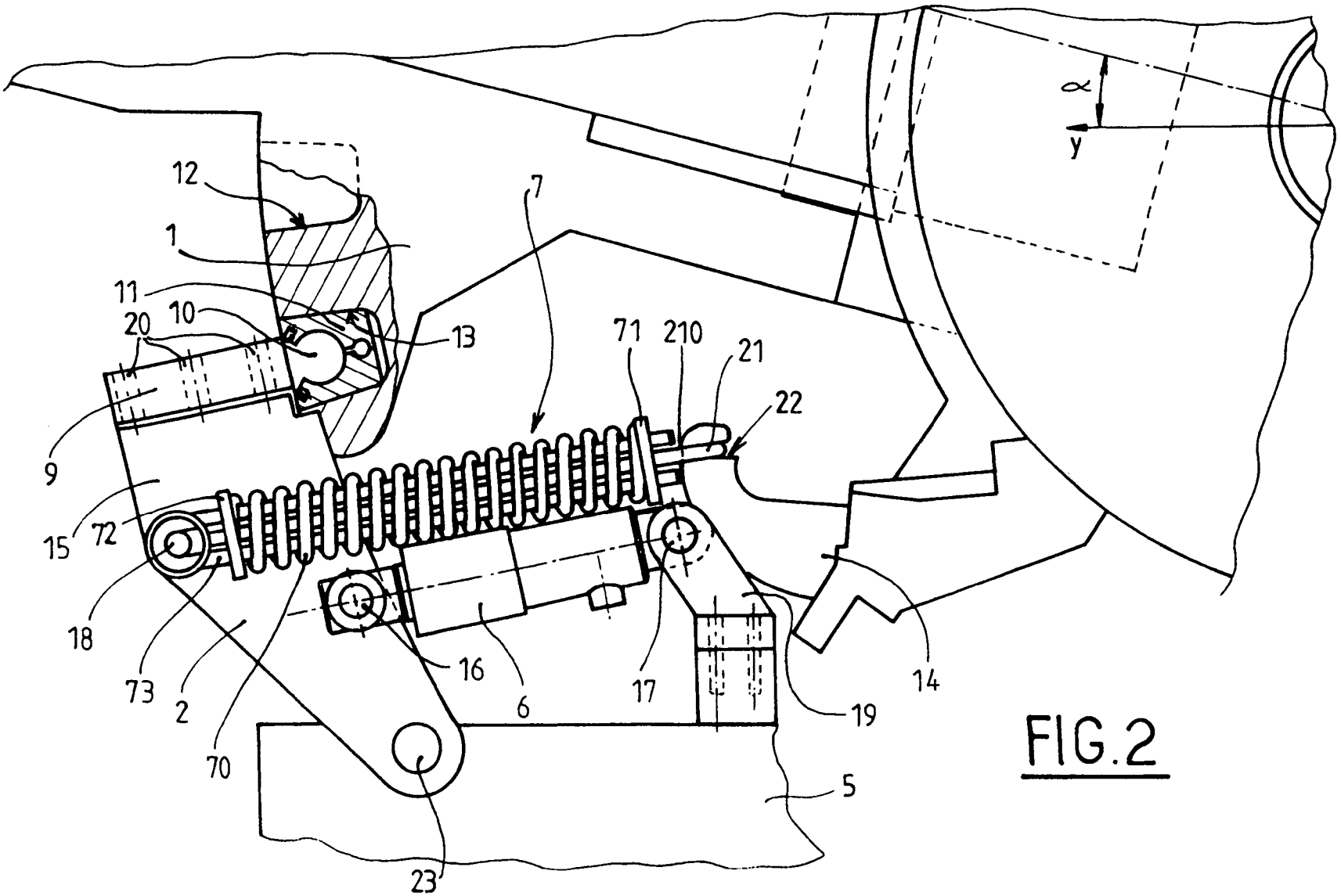
FIG. 2 is a partial section profile view of the device in a first locking position.

FIG. 2 shows the lashing device such as shown in FIG. 1 but at different scale.

The articulated part 2 incorporates a plate 15, fixed to the turret 5 by a pivot 23. Onto this plate are fixed the cylinder 6, spring 7 and a finger 9, whose end is provided with an elastic wedge 11, mounted on a cylindrical ball joint 10 and made so as to integrate into the indentations 12 and 13 in the cheek 1. The operating principle of the elastic wedge 11 will be detailed hereafter. The finger 9 is made integral with the plate 15, for example by fastening them together using screws 20 (of which only the axes are shown).

The cylinder 6 is fixed at one end of the plate 15, by means of a pivot 16 and at the other, by pivot 17, to an arm 19, integral with the turret 5. The elastic means 7 are fastened at one end to the plate 15, by means of a pivot 18, and at the other to a hook 14 integral with the turret 5.

The elastic means comprise a compression spring 70 positioned between two plates. A first plate 71 (to the right on the Figure) is integral with a stirrup 73 linked to pivot 18. A second plate 72 (to the left of the Figure) is integral with an axial rod 210 having a loop 21 engaged on the hook 14.

The spring 70 is compressed between the plates, it thus exerts a load tending to distance the plates from one another thereby making the cheek 1 come closer to the articulated part 2.

The elastic means 7 thereby ensure the lashing device is held in the locked state without the application of any further load being required.

The articulated part 2 is activated by means of a cylinder 6 so as to disengage the elastic wedge 11 from the indentation 12 or 13 of the cheek 1. The cylinder 6 is a classical pneumatic or hydraulic one. The cylinder 6 thus acts against the elastic means 7. When the cylinder 6 unlocks the lashing device it also compresses the spring 70 of the elastic means 7 which will ensure locking once again.

Figure 3A:
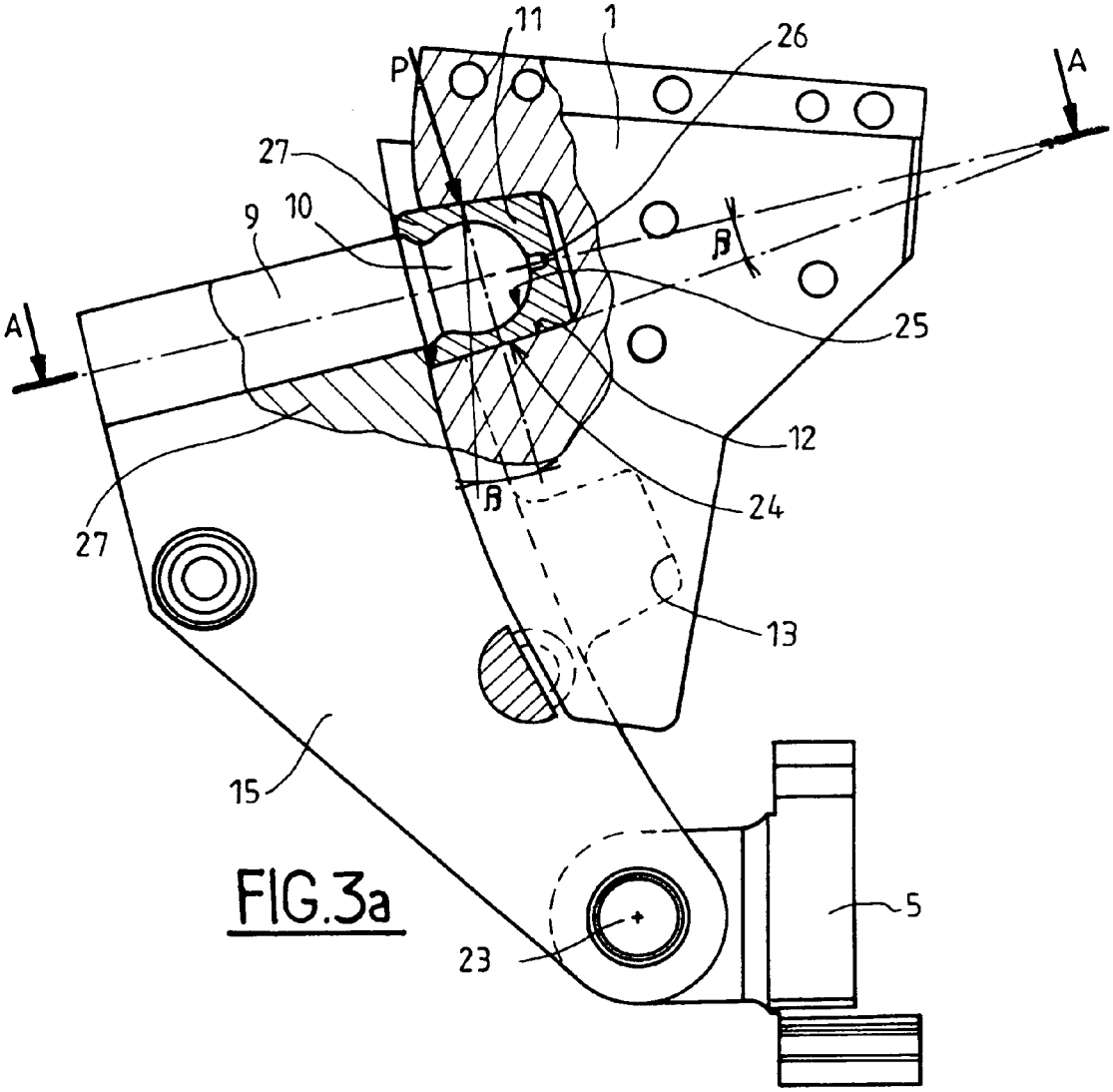
FIG. 3*a* is a partial view profile the device in another locking position.

FIG. 3*a* illustrates the operating principle of the lashing device according to the invention.

The elastic wedge 11 has a substantially trapeze shaped section whose central part has a cylindrical recess 25 and a transversal groove 26. The profile of the wedge 11 and groove 26 give this wedge its elastic properties, the wedge acting like a clip able to deform and whose arms 27 tend to come closer or move away from each other, according to the constraints to which they are subjected.

The cylindrical recess 25 of the wedge 11 cooperates with the end of the finger 9 so as to make a cylindrical knuckle 10. The elastic wedge and indentations 12 and 13 have matching profiles so as to make the integration of the wedge in the indentation as efficient as possible. Thanks to the wedge 11, the finger 9 is fastened in the indentation 12 or 13 with no play.

The faces 24 of the wedge 12 form an angle β with the axis of the finger 9.

The vector P represents the resultants of the loads exerted by the oscillating mass 3 on the joining means 11. According to an essential characteristic of the invention, the pivot 23 is positioned such that this resultant P generates a torque making the articulated part 2 pivot towards the cheek 1 (direction of P passing to the right of the pivot 23 in the plane of FIG. 3*a*).

This torque is a locking torque which is added to the action of the elastic means 7. Thus the load exerted results in the wedge 11 being inserted into its indentation 12 or 13.

Someone skilled in the art will easily determine by calculation the orientation and the intensity of the resultant P, thereby allowing him the correctly position the pivot 23.

This positioning will naturally be selected such that the resultant always exerts a locking torque whatever the conditions of employment (vibrations).

This avoids the inadvertent unlocking of the device which could occur, for example further to vibrations if the torque exerted by the resultant of the loads P were opposed to and greater than the elastic means 7.

Moreover, the angle β of the wedge 11 will be selected such that, given the friction, the unlocking load to be exerted by the cylinder 6 remains moderate. By way of example, for a cheek 1 and a wedge 11 made of steel, a wedge could be made having a half-angle less than 20° and preferably between 7° and 12°.

The load required from the unlocking cylinder will be minimal for an angle of between 10° and 12°.

Such an arrangement enables the wedge 11 to be held blocked in its indentation 12. The cheek 1 bearing the indentation 12 is integral with the oscillating mass 3 carrying the gun barrel 4, itself in rotation with respect to the vehicle's turret 5. The elastic wedge 11 is integral with the articulated part 2, itself in rotation with respect to the vehicle's turret 5. By blocking the elastic wedge 11 in an indentation 12 or 13 of the cheek 1, the gun barrel 4 is thus locked in position with respect to the turret 5 of the vehicle.

Figure 3B:
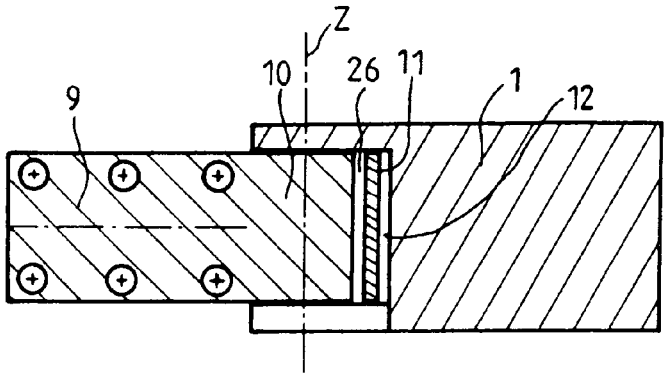
FIG. 3*b* is a section view of the device along axis AA in FIG. 3*a*.

FIG. 3*b* is a section view of the device, along axis AA in FIG. 3*a*. This view reveals the groove 26 made in the wedge 11 and coincides with the plane of section AA as well as the cylindrical end 10 of the finger 9 (cylinder with axis Z). The width of the finger 9 and the wedge 11 is less than that of the indentation 12 so as to give a little play to facilitate the insertion of the wedge in the indentation. Here, the indentation 12 is open on one edge of the cheek 1.

These embodiments of the invention are given merely by way of illustration. Other embodiments of the invention may naturally be envisaged. For the sake of clarity, the description is limited to a cheek with two indentations, but the invention may also be produced with a cheek having only one indentation or 3 or more indentations. The invention may be made with a wedge 11 made of other materials than steel, for example brass or composite materials.

Figure 4:
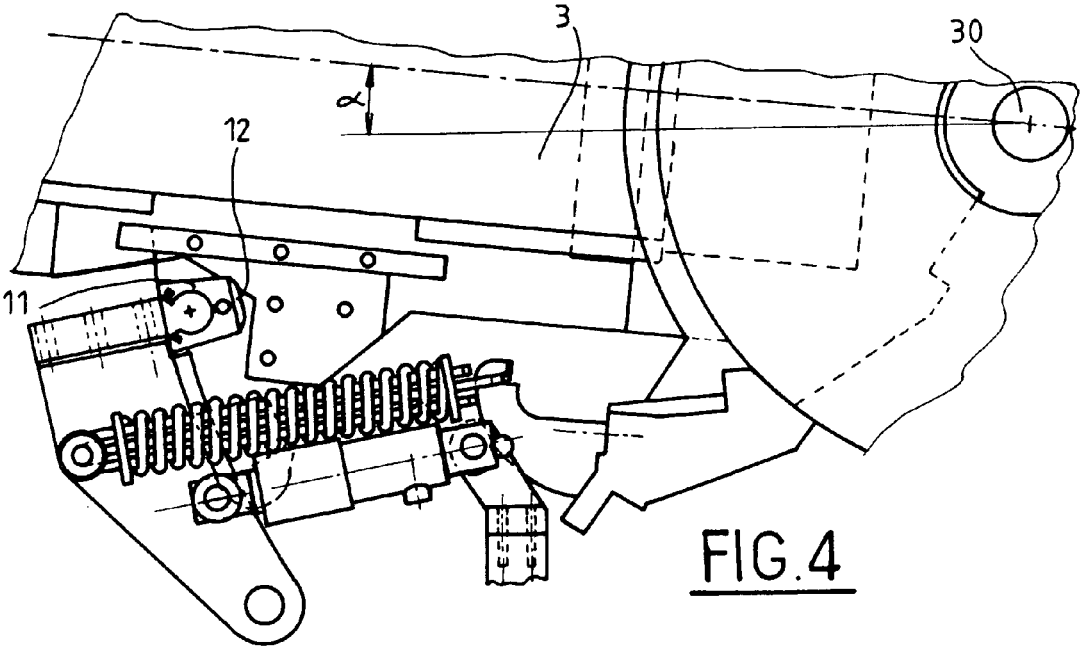
FIG. 4 is a profile view of the device in a second locking device.
Figure 5:
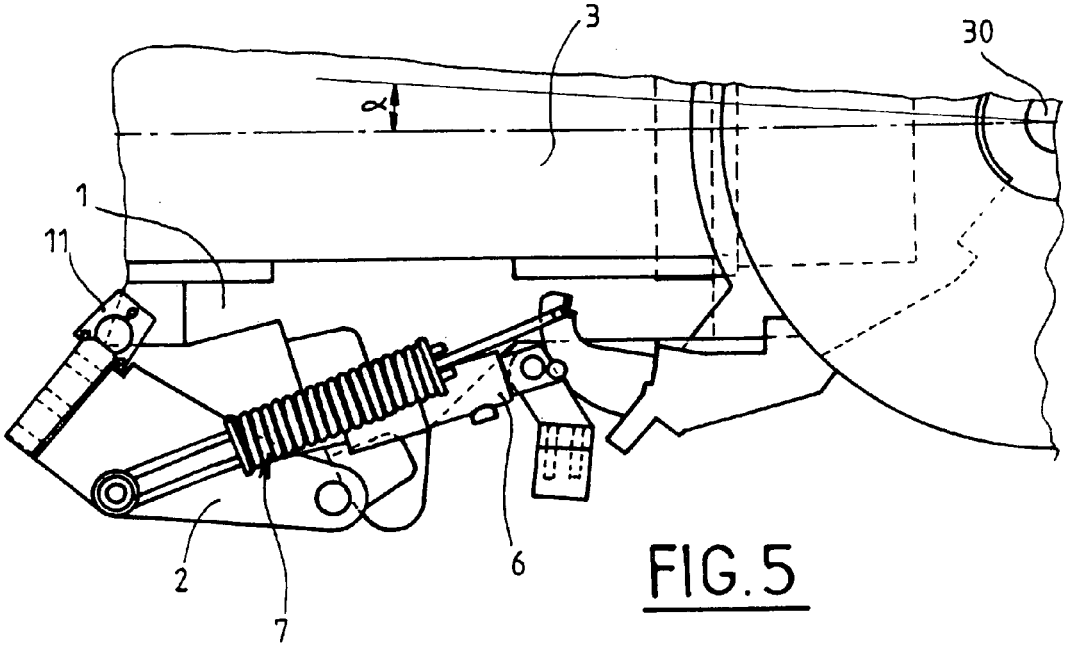
FIG. 5 is a profile view of the device is an unlocked position.

FIG. 4 shows the lashing device is a second locking position and FIG. 5 shows the device unlocked.

FIG. 4 shows the device according to the invention in a second locking position. In this example, the elastic wedge 11 is inserted into the indentation 12. The device is identical to that shown in FIGS. 1 and 2 and its position with respect to the vehicle's turret is identical to that shown in FIG. 2. Contrary to FIG. 2, in this Figure the cannon has been displaced angularly so as to form an angle α of 6° with respect to the horizontal. The elastic wedge 11 has then been inserted into the indentation 12 so as to lock the cannon in place.

FIG. 5 shows the same cannon equipped with the device according to the invention but in a configuration in which the device is fully unlocked. In this configuration, the articulated part 2 is totally distanced from the cheek 1. The spring of the elastic means 7 is fully compressed and the piston of the cylinder 6 is fully extracted. In this configuration, the cannon is fully released and may be put in any position with respect to the turret so as to satisfy firing conditions. The organs or manoeuvre of the cannon are classical and do not, therefore, require further explanation.

What is claimed is:

1. A gun barrel fastening device that fastens, with respect to the turret of a carrier vehicle, an oscillating mass carrying the gun barrel, the gun barrel fastening device comprising:

a cheek integral with the oscillating mass; and an articulated part fastened to the turret by a pivoting link, the articulated part comprising means for joining the articulated part with the cheek, wherein the pivoting link is positioned such that a load exerted by the oscillating mass on the joining means generates a torque making the articulated part pivot toward the cheek.

2. The gun barrel fastening device according to claim 1, wherein the means for joining the articulated part with the cheek is an elastic wedge that engages at least one indentation in the cheek.

3. The gun barrel fastening device according to claim 2, wherein the cheek includes a plurality of indentations allowing the oscillating mass to be immobilised in different angular positions.

4. The gun barrel fastening device according to claim 2, wherein the articulated part is activated by means of a cylinder to engage or disengage the elastic wedge with the at least one indentation.

5. The gun barrel fastening device according to claim 2, further comprising an elastic means acting to hold the elastic wedge engaged with the at least one indentation.

6. The gun barrel fastening device according to claim 2, wherein the elastic wedge is substantially trapezoidal in shape.

7. The gun barrel fastening device according to claim 2, wherein the elastic wedge is carried by a cylindrical knuckle integral with the articulated part.

* * * * *